US007747212B2

(12) United States Patent
Yamamoto

(10) Patent No.: US 7,747,212 B2
(45) Date of Patent: Jun. 29, 2010

(54) SHEET PROCESSING APPARATUS AND SHEET PROCESSING METHOD

(75) Inventor: Mikio Yamamoto, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 536 days.

(21) Appl. No.: 11/670,079

(22) Filed: Feb. 1, 2007

(65) Prior Publication Data

US 2008/0187383 A1 Aug. 7, 2008

(51) Int. Cl.
*G03G 15/00* (2006.01)
*B65H 37/04* (2006.01)
*B65H 39/00* (2006.01)

(52) U.S. Cl. ..... 399/408; 399/407; 399/381; 270/58.08; 270/58.09; 270/58.12

(58) Field of Classification Search ..... 399/361, 399/363, 381–387, 407–411; 271/3.01–3.03, 271/144, 226–255, 145, 171, 176, 177; 270/58.08–58.26; *G03G 15/00; B65H 39/02, 31/30, 37/04, B65H 39/00*

See application file for complete search history.

(56) References Cited

U.S. PATENT DOCUMENTS 6,102,385 A * 8/2000 Wakamatsu et al. ..... 270/58.12
6,430,382 B1 * 8/2002 Okamoto et al. ..... 399/82
7,413,176 B2 * 8/2008 Hirata et al. ..... 270/58.08
2007/0075482 A1 * 4/2007 Fujita et al. ..... 271/220

FOREIGN PATENT DOCUMENTS

JP 2003-118928 4/2003
JP 2005096933 A * 4/2005

* cited by examiner

*Primary Examiner*—Judy Nguyen
*Assistant Examiner*—Wyn Q Ha
(74) *Attorney, Agent, or Firm*—Turocy & Watson, LLP

(57) ABSTRACT

A sheet processing apparatus of the invention includes a post-processing unit that applies post-processing to sheets conveyed from an image forming apparatus, a vertical aligning unit that conveys the sheets to the post-processing unit and brings an edge of the sheets into contact with a movable stopper arranged in a conveying path for the sheets to align the sheets in a conveying direction, and a horizontal aligning unit that holds the sheets with a pair of movable aligning plates from both sides along the conveying direction to align the sheets in a direction orthogonal to the conveying direction. The sheet processing apparatus further includes a control unit that switches a position of the stopper according to a size of the sheets and controls the aligning plates to be located on both sides close to the center of the sheets when the sheets are brought into contact with the stopper. The post-processing unit applies the post-processing to the sheets aligned.

9 Claims, 13 Drawing Sheets

SHEET PROCESSING APPARATUS AND SHEET PROCESSING METHOD

BACKGROUND OF THE INVENTION

1. Field of the Invention

The present invention relates to a sheet processing apparatus and a sheet processing method for performing post-processing for sheets discharged from an image forming apparatus such as a copying machine, a printer, or a multifunction peripheral (MFP).

2. Description of the Related Art

In recent years, among image forming apparatuses, there is an image forming apparatus in which a sheet post-processing apparatus is provided adjacent to an image forming apparatus main body in order to perform post-processing such as processing for sorting sheets after image formation and processing for applying staple processing to the sheets.

In JP-A-2003-118928, a sheet post-processing apparatus is described. In this example, a structure that makes it possible to move an alignment position and a stapler according to a sheet size is extremely complicated.

The present invention provides a sheet processing apparatus that can appropriately align sheets to be subjected to post-processing according to a size of the sheets.

DETAILED DESCRIPTION OF THE INVENTION

Figure 1:
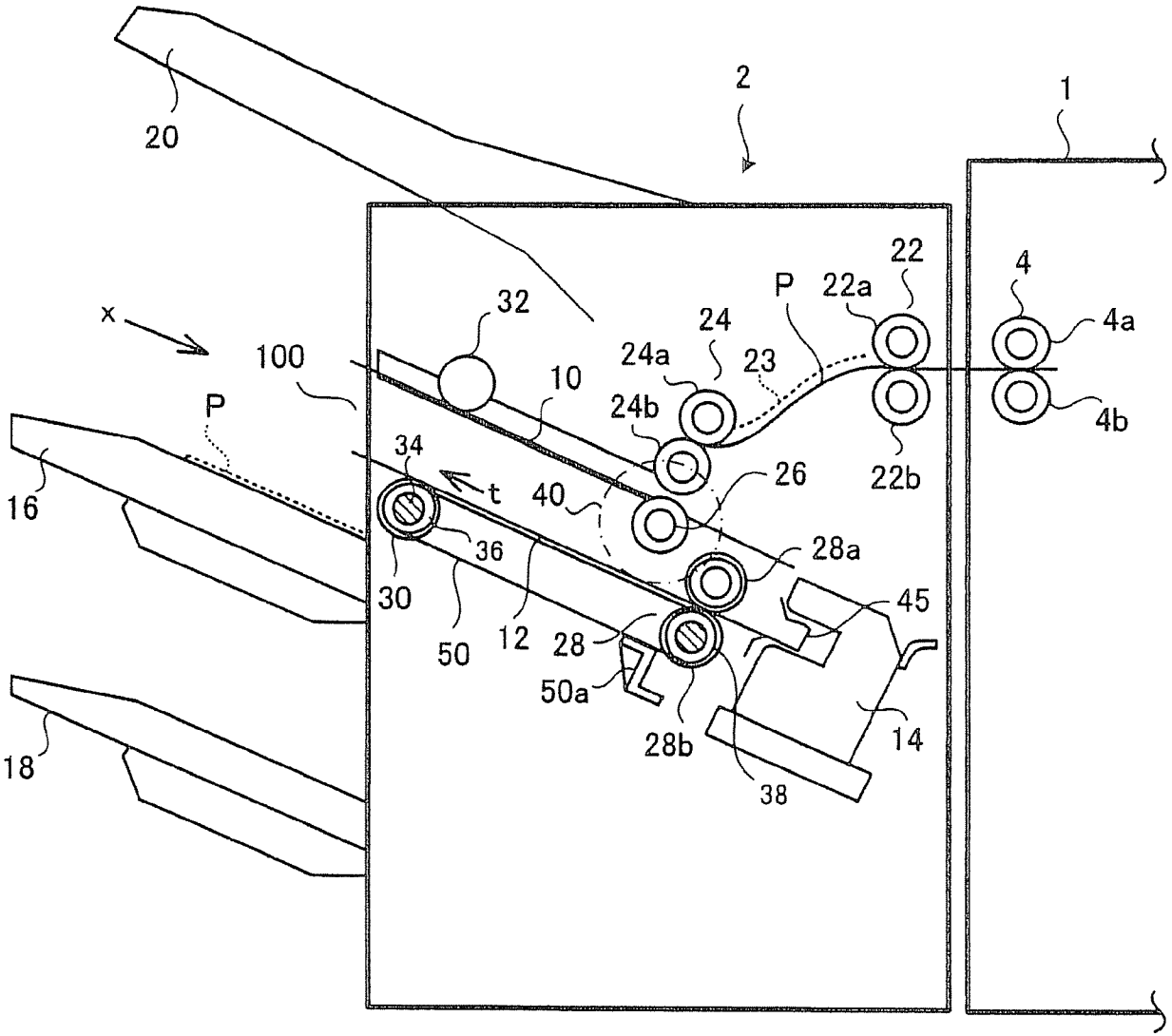
FIG. 1 is a schematic diagram showing a sheet processing apparatus according to an embodiment of the invention.

Throughout this description, the embodiments and examples shown should be considered as exemplars, rather than limitations on the apparatus of the present invention.

Embodiments of the invention will be hereinafter explained in detail with reference to the drawings. In the respective figures, identical components are denoted by identical reference numerals and signs.

FIG. 1 is a schematic diagram showing a sheet post-processing apparatus 2 arranged adjacent to an image forming apparatus 1 such as a copying machine. A sheet P having an image formed thereon by the image forming apparatus 1 is discharged from discharge rollers 4 and conveyed to the sheet post-processing apparatus 2. The discharge rollers 4 include an upper roller 4*a* and a lower roller 4*b*.

The sheet post-processing apparatus 2 has a standby tray 10, a processing tray 12, a stapler 14, a first sheet discharge tray 16, a second sheet discharge tray 18, and a fixed tray 20.

The sheet P discharged by the discharge rollers 4 of the image forming apparatus 1 is received by inlet rollers 22 provided near a delivery port of the sheet processing apparatus 2. The inlet rollers 22 include an upper roller 22*a* and a lower roller 22*b* and are driven by a motor (not shown).

Sheet feeding rollers 24 are provided on a downstream side of the inlet rollers 22. The sheet P received by the inlet rollers 22 is sent to the standby tray 10 via the sheet feeding rollers 24. A paper path 23 for guiding the sheet P to the sheet feeding rollers 24 is provided between the inlet rollers 22 and the standby tray 10. The sheet feeding rollers 24 include an upper roller 24*a* and a lower roller 24*b*.

The processing tray 12 for stacking the sheet P, which has fallen from the standby tray 10, is arranged below the standby tray 10. The standby tray 10 stacks the sheet P and has an openable structure. When a predetermined number of sheets P are accumulated, the standby tray 10 opens and the sheets P falls to the processing tray 12 because of an own weight of the sheets P. The processing tray 12 aligns and supports the sheets P while the sheets P are stapled by the stapler 14 serving as a post-processing mechanism.

The sheets, which have fallen in the processing tray 12, are guided to the stapler 14 by rollers 28 and subjected to staple processing. The rollers 28 include an upper roller 28*a* and a lower roller 28*b*. When the staple processing is performed, the plural sheets P, which have fallen from the standby tray 10 to the processing tray 12, are subjected to the staple processing after being aligned in the vertical direction, which is a conveying direction, and aligned in a horizontal direction orthogonal to the conveying direction.

A rotatable paddle 40 is arranged in a position to which the trailing end of the sheet P falls when the sheet P falls to the processing tray 12.

Figure 4:
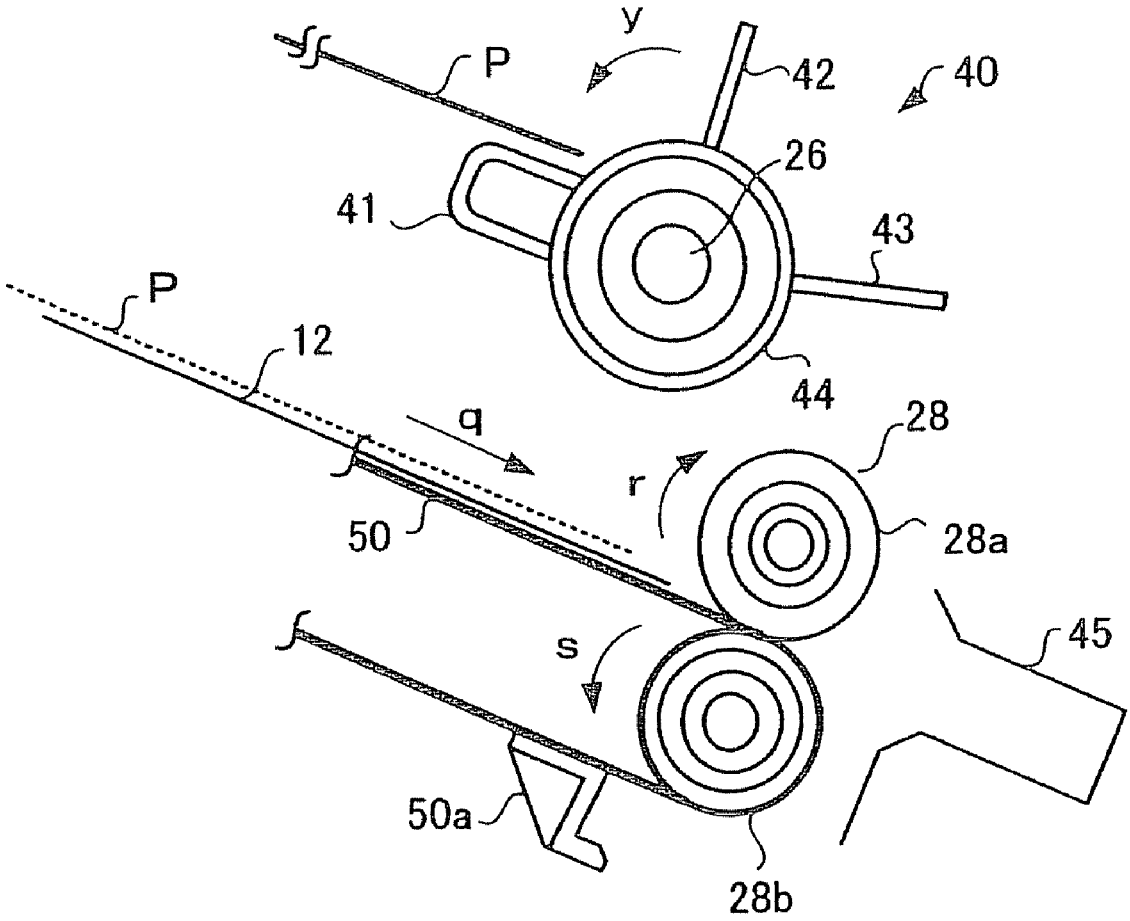
FIG. 4 is an explanatory diagram showing a paddle of the sheet processing apparatus of the invention.

The paddle 40 is attached to a rotating shaft 26. The paddle 40 pats down the sheet P falling from the standby tray 10 onto the processing tray 12 and sends the sheet P in a direction of the stapler 14. Details of the paddle 40 are shown in FIG. 4 and described later.

A stopper 45 that regulates the trailing end position of the sheet P is provided at an end on the stapler 14 side of the processing tray 12. There is also provided a conveyor belt 50 that conveys the sheets P, which are subjected to sort processing or staple processing, to the first sheet discharge tray 16 or the second sheet discharge tray 18.

The conveyor belt 50 is suspended between pulleys 36 and 38. A pawl member 50*a* that hooks the trailing end of the sheets P and sends the sheets P is attached to the conveyor belt 50. The lower roller 28*b* of the rollers 28 is arranged coaxially with the pulley 38. The rollers 28 rotate in opposite directions when the rollers 28 guide aligned sheets in the direction of the stapler 14 and when the rollers 28 discharge the sheets P subjected to the staple processing.

The pulley 36 is attached to a shaft 34. Plural discharge rollers 30 are rotatably attached to this shaft 34.

The sheets P conveyed by the conveyor belt 50 are discharged to the first sheet discharge tray 16 or the second sheet discharge tray 18 from a discharge port 100. The first sheet discharge tray 16 and the second sheet discharge tray 18 are lifted and lowered by a driving unit (not shown) and receive the sheets P.

The sheets P stacked on the standby tray 10 may be discharged to the first sheet discharge tray 16 or the second sheet discharge tray 18 without being subjected to the staple processing. In this case, the sheets P are discharged by a roller 32 without being caused to fall to the processing tray 12.

It is also possible to discharge the sheets P not required to be subjected to post-processing to the fixed tray 20. A conveying path is provided to guide the sheets P to the fixed tray 20. The conveying path is not shown in the figure.

Figure 2:
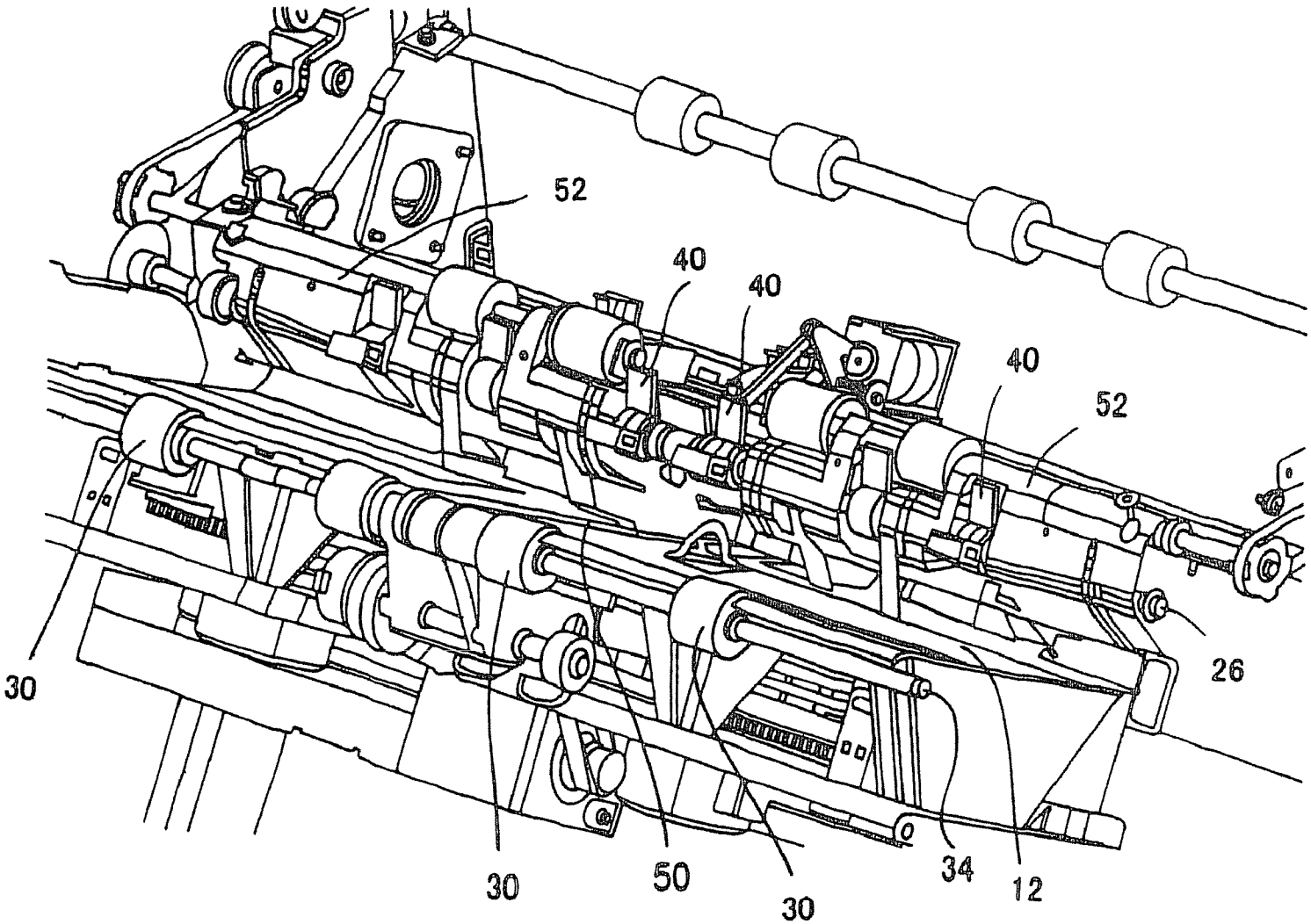
FIG. 2 is a perspective view showing a main part of the sheet processing apparatus of the invention.

FIG. 2 is a perspective view of a main part of the sheet post-processing apparatus 2 and is a diagram of the main part viewed from an arrow x direction in FIG. 1.

In FIG. 2, the shaft 34 is arranged orthogonal to the conveying direction of the sheets P. The pulley 36 is attached to the middle of the shaft 34. The belt 50 is looped around this pulley 36. The discharge rollers 30 are attached to the center and both the sides of the shaft 34. The discharge rollers 30 are subjected to rotation control by the driving unit and rotate when the sheets P are discharged to the tray 16 or 18.

Figure 3:
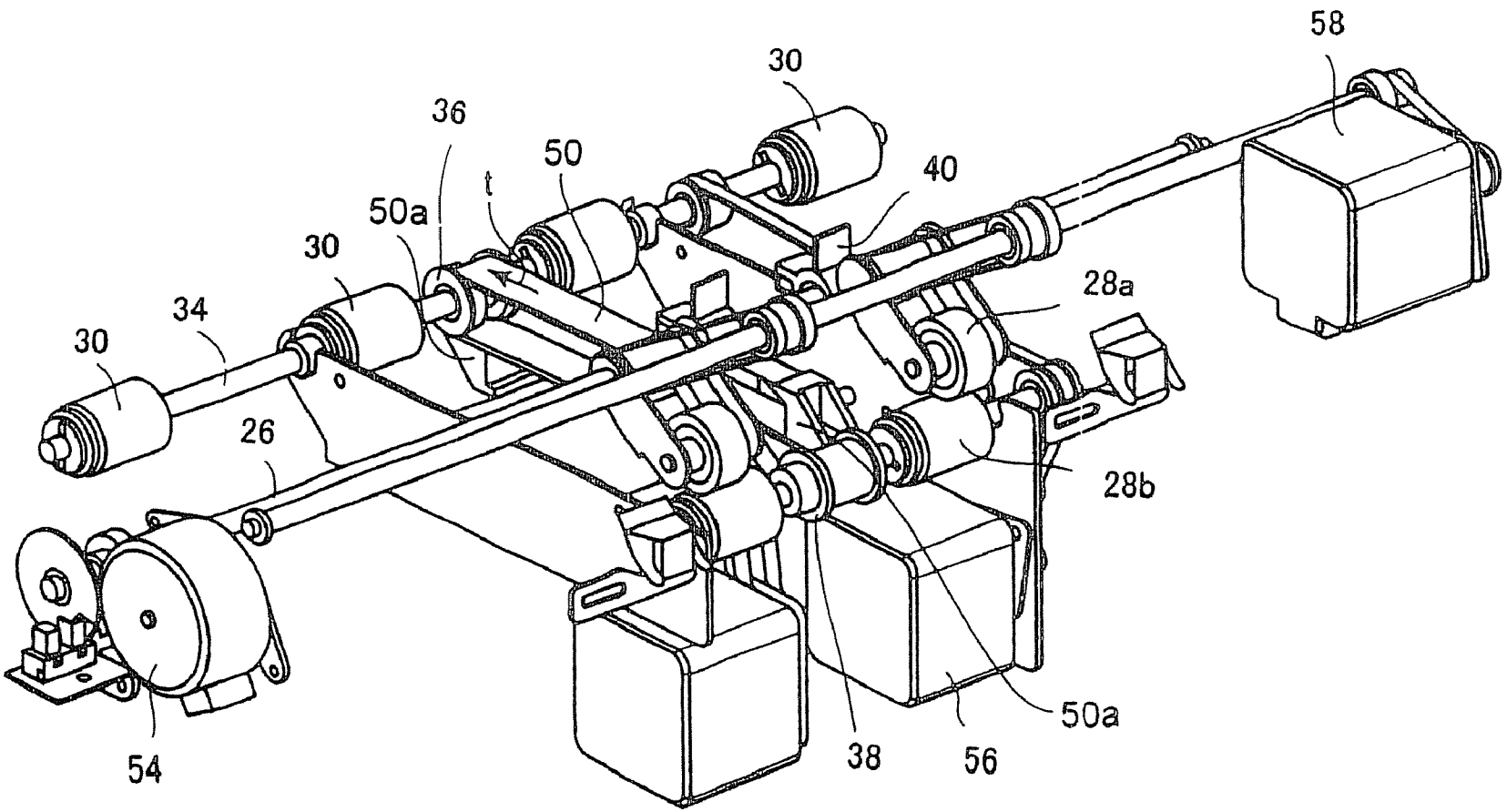
FIG. 3 is a schematic perspective view showing a roller for vertical alignment of the sheet processing apparatus of the invention.

FIG. 3 is a schematic perspective view showing structures of the rollers 28 for vertical alignment of the sheets P, the paddles 40, and the conveyor belt 50. As shown in FIG. 3, the conveyor belt 50 is suspended between the pulleys 36 and 38 and driven to rotate by a motor 56. The conveyor belt 50 cyclically rotates between the stapler 14 and the sheet discharge port 100 (FIG. 1) along a discharge direction of sheets.

The sending pawl 50*a* that hooks the trailing end of a sheet bundle T is attached to the conveyor belt 50. The sending pawl 50*a* conveys the sheets P or the sheet bundle subjected to the post-processing to the discharge port 100 according to the rotation of the conveyor belt 50.

In conveying the sheets P in the direction of the sheet discharge trays 16 and 18, the conveyor belt 50 moves in an arrow t direction and the upper roller 28*a* and the lower roller 28*b* for vertical alignment rotate in an arrow r direction and an arrow s direction in FIG. 4. The upper roller 28*a* for vertical alignment is driven to rotate by a motor 58 and the lower roller 28*b* is driven to rotate by the motor 56 that drives the conveyor belt 50.

A plurality of the paddles 40 are attached to the rotating shaft 26. The rotating shaft 26 is driven to rotate by a motor 54. Alternatively, a rotational force of a motor may be transmitted to the rotating shaft 26 via a gear mechanism.

FIG. 4 is a diagram for explaining a structure and an operation of the paddle 40. In the paddle 40, an attachment member 44 is attached to the rotating shaft 26. The attachment member 44 includes a receiving section 41 that receives the trailing end of the sheet P that is placed in the standby tray 10, a patting section 42 that pats down the sheet P onto the processing tray 12, and a sending section 43 that sends the sheet P on the processing tray 12 in the direction of the stapler 14. The patting section 42 and the sending section 43 of the paddle 40 are made of a rubber material and have elasticity.

The paddle 40 rotates in a y direction around the rotating shaft 26, pats down the trailing end of the sheet P received by the receiving section 41 onto the processing tray 12 with the patting section 42, and sends the sheet P in the direction of the stapler 14 with the sending section 43.

When the sheet P on the processing tray 12 is sent in the direction of the stapler 14 (an arrow q), the upper roller 28*a* of the roller 28 rotates counterclockwise and the lower roller 28*b* rotates clockwise. When the sheet P on the processing tray 12 is discharged, the upper roller 28*a* rotates in the arrow r direction and the lower roller 28*b* rotates in the arrow s direction.

As it is seen from FIG. 2, the plurality of the paddles 40 are attached to the rotating shaft 26. A guide member 52 is provided in order to guide sheets to the processing tray 12. The guide member 52 serves as a guide in pulling the trailing end of the sheet P conveyed into the stapler 14 side.

Figure 5:
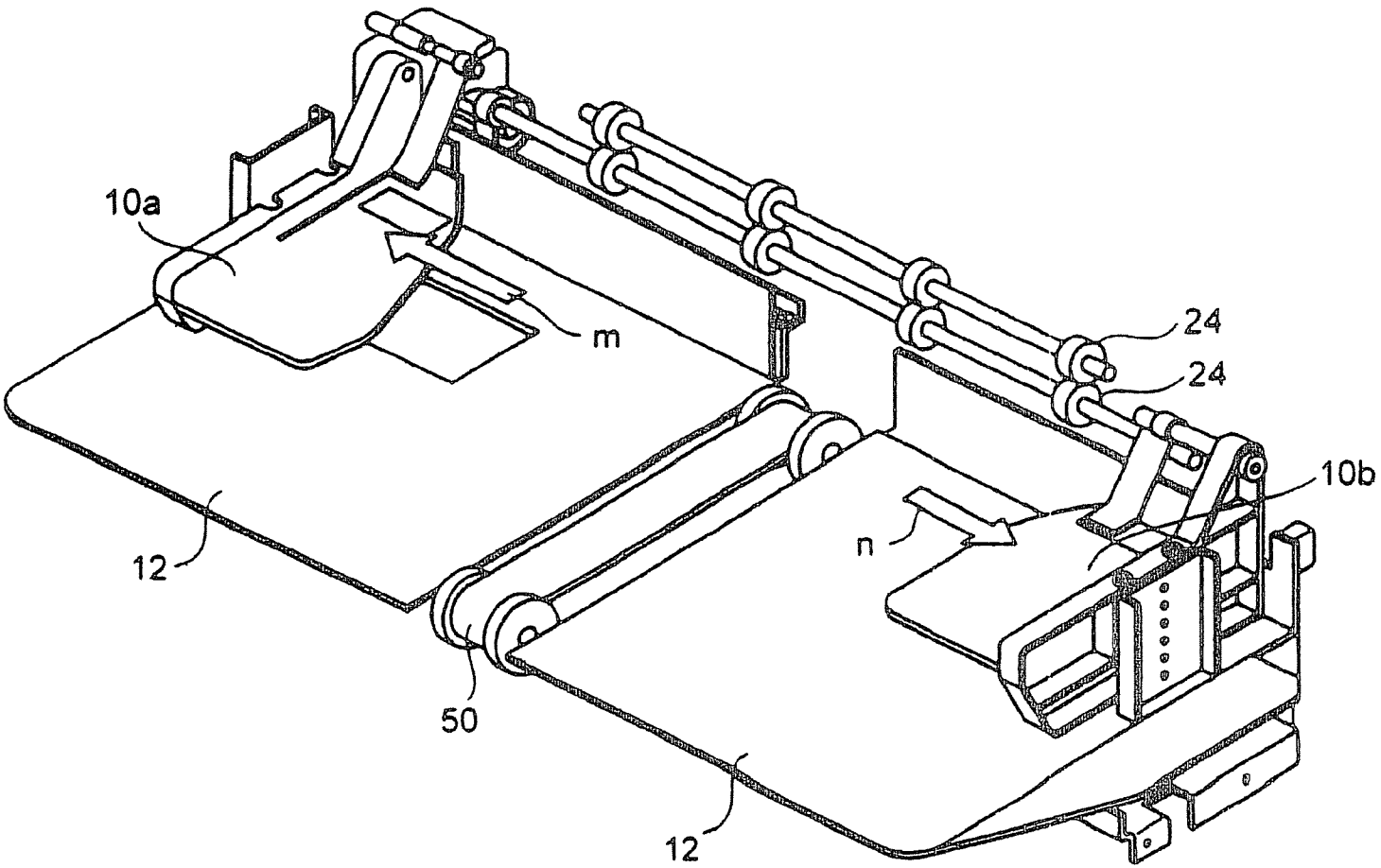
FIG. 5 is a schematic perspective view showing a standby tray and a processing tray of the sheet processing apparatus of the invention.
Figure 6:
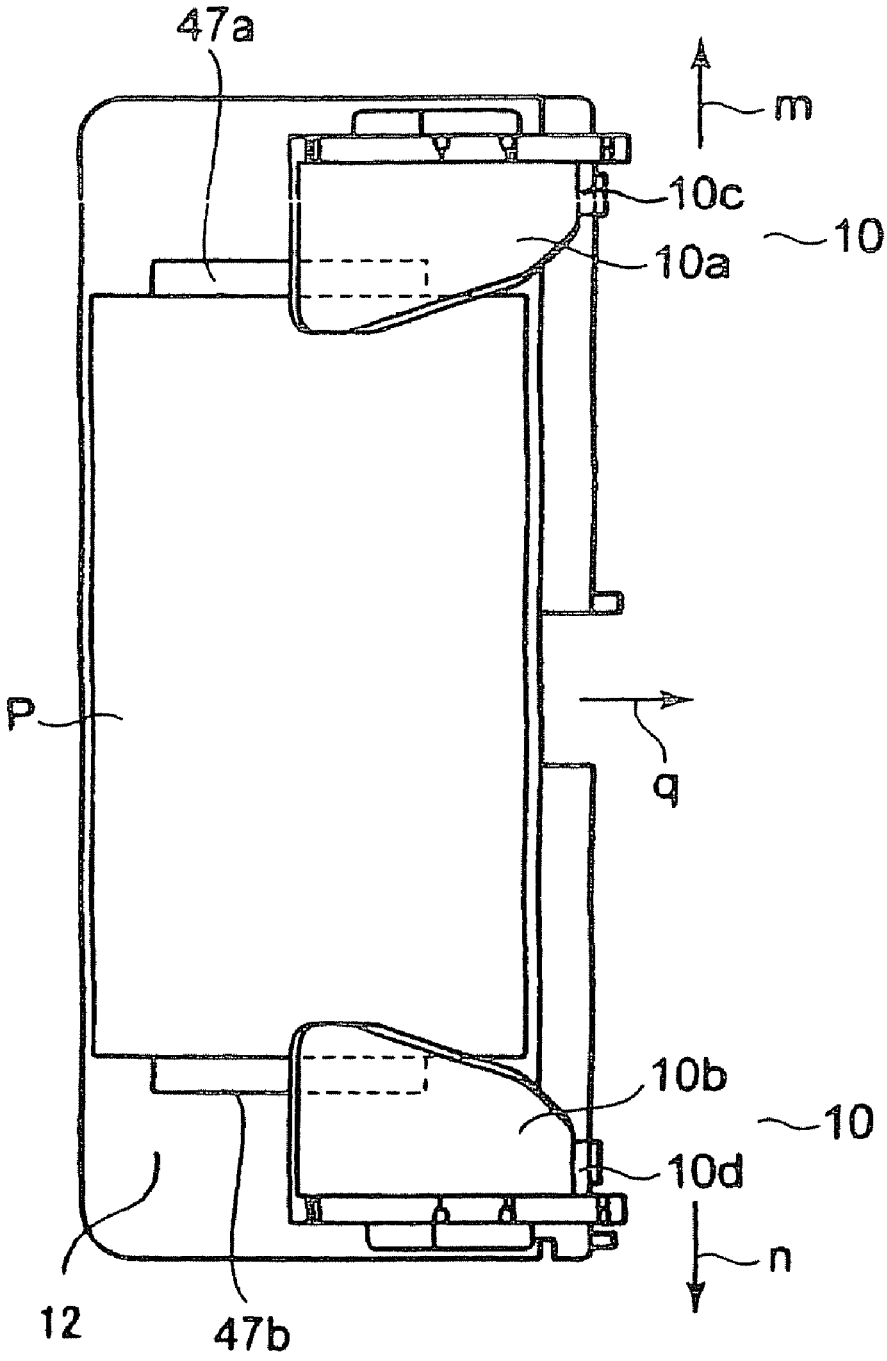
FIG. 6 is a plan view showing the standby tray and the processing tray of the sheet processing apparatus of the invention.

FIGS. 5 and 6 are diagrams schematically showing the standby tray 10 and the processing tray 12. The standby tray 10 includes a pair of tray members 10*a* and 10*b*. The tray members 10*a* and 10*b* receive the sheets P in a state in which the tray members 10*a* and 10*b* are slid to the width of the sheet P and support both the sides of the sheets P. Standby stoppers 10*c* and 10*d* that regulate the trailing end of the sheets P are provided in the tray members 10*a* and 10*b*.

The standby tray 10 is slid in arrows m and n directions by a motor (not shown). Between the standby tray 10 and the processing tray 12, when the sheets P on the standby tray 10 are dropped and supplied to the processing tray 12, the sheets P may be disarranged in the horizontal direction orthogonal to the conveying direction.

Figure 7:
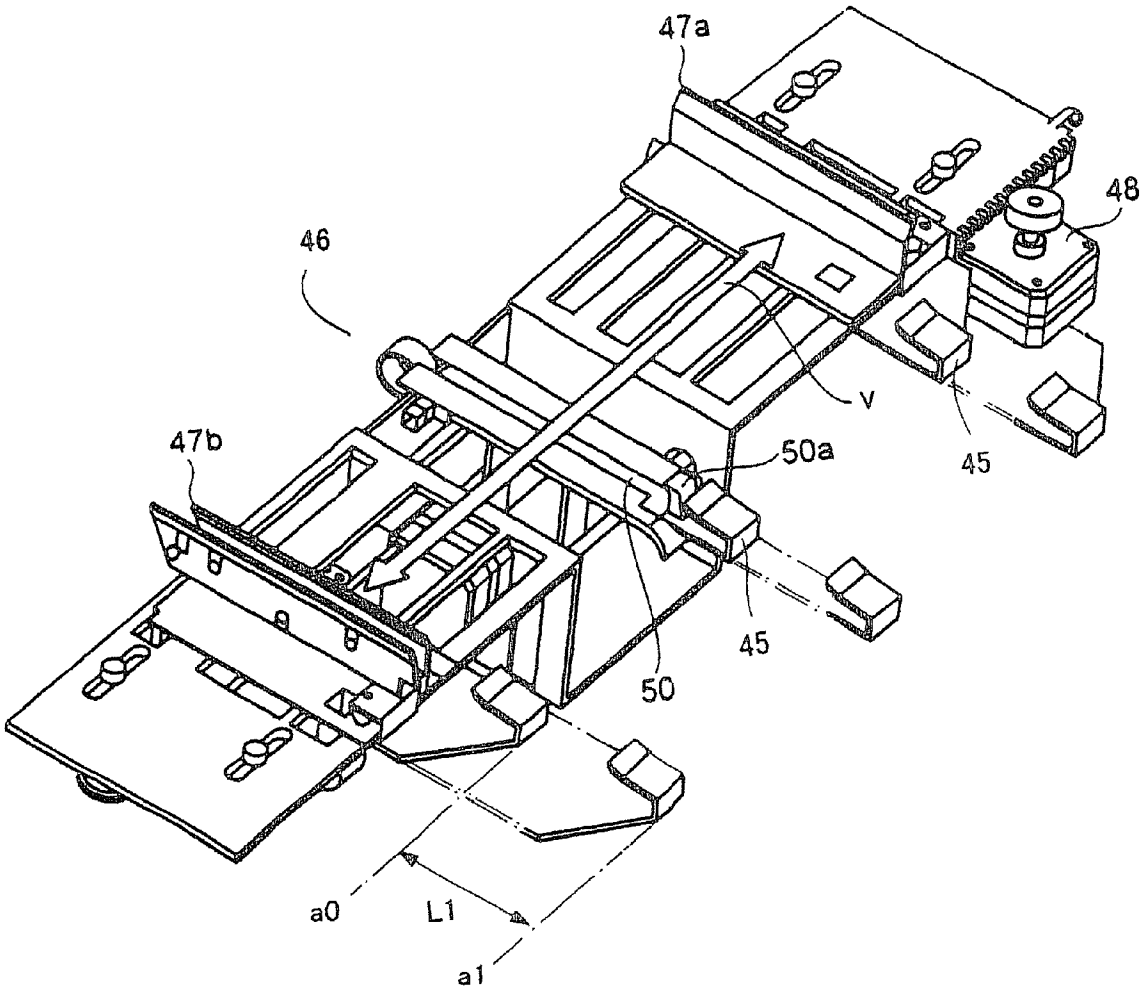
FIG. 7 is a schematic perspective view showing a horizontal aligning plate of the sheet processing apparatus of the invention.

Therefore, as shown in FIG. 7, a horizontal aligning device 46 that prevents disarrangement of the sheets P is provided. The horizontal aligning device 46 has a pair of horizontal aligning plates 47*a* and 47*b*. The horizontal aligning plates 47*a* and 47*b* are slidable in a v direction by a motor 48 to be fit to the width of the sheets P. It is possible to change an alignment position with the motor 48.

The stoppers 45 that regulate a trailing end position of the sheets P are provided in the horizontal aligning device 46. The stoppers 45 are slidable in the conveying direction of the sheets P (a direction orthogonal to the slide direction v of the horizontal aligning plates 47*a* and 47*b*) A stopper control unit 72 (see FIG. 9) is provided in order to slide the stoppers 45. The stopper control unit 72 adopts, for example, a stepping motor as a driving source and slides the stoppers 45 by a predetermined distance L1 between a first position a0 and a second position a1.

When the stoppers 45 regulate the trailing end position of the sheets P of a small size, the stoppers 45 are in the position a0 shown in FIG. 7. When the stoppers 45 regulate the trailing end position of the sheets P of a large size, the stoppers 45 are slid and moved to the second position a1 as indicated by an alternate long and short dash line. The second position a1 is located in a depth direction opposite to the discharging direction of the sheets P.

The sheets P of the small size are, for example, sheets of an A4 size and the sheets P of the large size are, for example, sheets of an A3 size. In this way, a position where the stoppers 45 receive sheets changes according to a sheet size. When the staple processing is performed, the stoppers 45 always return to the first position a0.

The horizontal aligning device 46 can shift positions of sheets by controlling to slide the horizontal sliding plates 47*a* and 47*b* in the v direction. The horizontal aligning plates 47*a* and 47*b* are also used in sorting and discharging the sheets P.

Figure 8A:
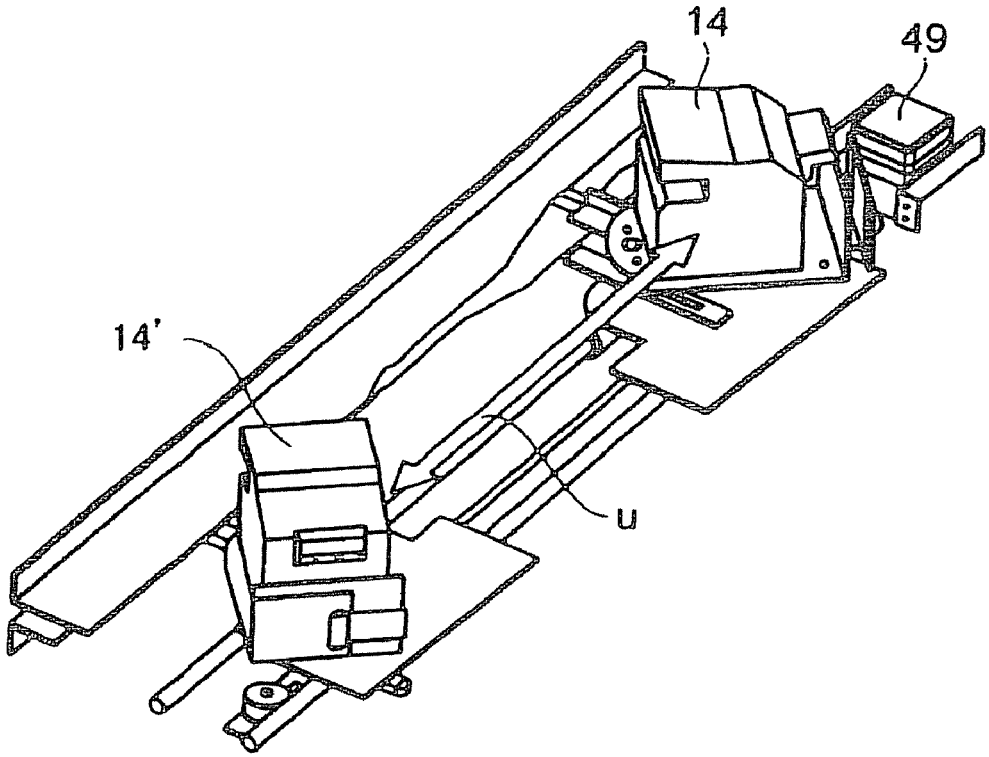
FIG. 8A is a schematic perspective view showing a stapler of the sheet processing apparatus of the invention.

FIG. 8A is a diagram showing a structure of the stapler 14. The stapler 14 is slidable in a u direction by the motor 49. In stapling sheets, the stapler 14 moves along the trailing end of the sheets P and performs the staple processing in a predetermined position. Although there is only one stapler 14, in FIG. 8A, the stapler before sliding is indicated by 14 and the stapler after sliding is indicated by 14'.

Figure 8B:
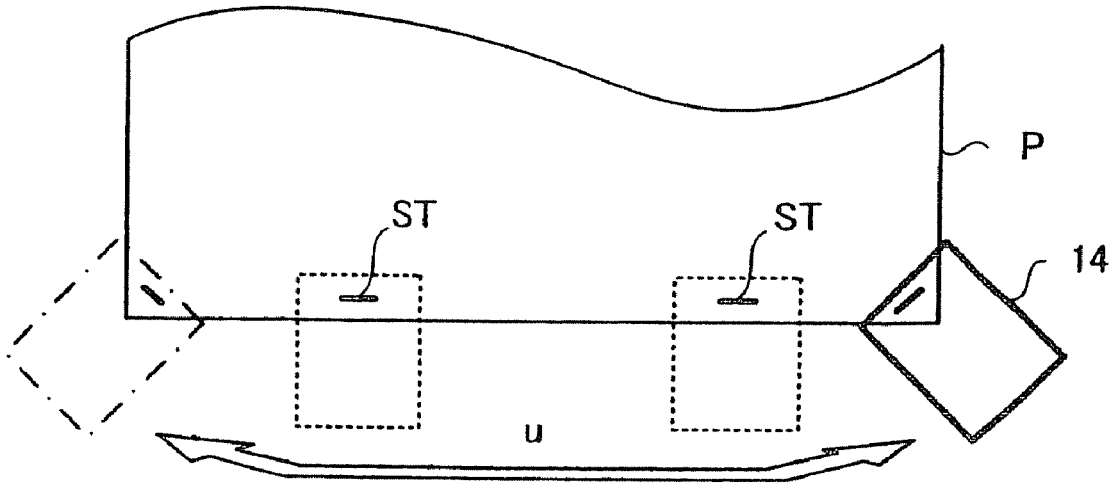
FIG. 8B is an explanatory diagram schematically showing an operation of the stapler of the sheet processing apparatus of the invention.

FIG. 8B is a diagram for explaining the movement of the stapler 14. As shown in FIG. 8A, the stapler 14 is slidable in the u direction by the motor 49. When a corner portion of the sheets P is bound, the stapler 14 moves to a position indicated by a solid line or an alternate long and short dash line in FIG. 8B and performs the staple processing. When plural places (e.g., two places) along an edge of the sheets P are bound, the stapler 14 moves to positions indicated by dotted lines in FIG. 8B, respectively, and applies staple processing ST to the sheets P.

Driving units such as the motors 48, 49, 54, 56, and 58 that drive the various mechanisms described above are controlled to be driven by a control circuit.

An operation of the post-processing by the sheet post-processing apparatus 2 will be explained according to a flow of sheets. Sheets subjected to the post-processing are discharged to the sheet discharge tray 16 or 18. In the following explanation, as a representative example, the sheets are discharged to the sheet discharge tray 16.

The sheets P conveyed from the inlet rollers 22 via the paper path ceiling 23 are fed onto the standby tray 10 by the sheet feeding rollers 24. Subsequently, the sheets P fall onto the processing tray 12.

When the sheets P fall, the upper roller 28*a* for vertical alignment is retracted upward and the receiving section 41 of the paddle 40 receives the trailing end of the sheets P. Both the ends of the sheets P fall in contact with the horizontal aligning plates 47*a* and 47*b* and alignment in the horizontal direction is performed.

Subsequently, the paddles 40 rotate in the arrow y direction as shown in FIG. 4, the trailing end of the sheets P falls from the receiving sections 41, and the sheets P are patted down onto the processing tray 12 by the patting sections 42. Moreover, the paddles 40 send the sheets P in an arrow q direction with the sending section 43, bring the trailing end of the sheets P into contact with the stoppers 45, and complete the alignment in the vertical direction of the sheets P.

In this way, the sheets P having images formed thereon are guided from the sheet feeding rollers 24 to the processing tray 12 while being sequentially aligned in the horizontal and the vertical directions.

In performing the staple processing, when the sheets P stacked on the processing tray 12 reach a predetermined number, the stapler 14 staples the sheets P on the processing tray 12 in a desired position and forms a sheet bundle. Thereafter, as shown in FIG. 4, the sheet bundle is nipped by the upper roller 28*a*, which rotates in the arrow r direction, and the lower roller 28*b*, which rotates in the arrow s direction, and conveyed in the direction of the sheet discharge tray 16.

When the trailing end of the sheet bundle passes the rollers 28*a* and 28*b*, the sheet bundle is hooked by the sending pawl 50*a* of the conveyor belt 50, which is rotated in the arrow t direction, conveyed to the sheet discharge tray 16, and thereafter discharged onto the sheet discharge tray 16 by the discharge rollers 30.

It is also possible to shift the sheets in the width direction by operating the horizontal aligning plates 47*a* and 47*b* and sort and discharge the sheets.

The operations of the entire sheet post-processing apparatus 2 are explained above. A structure of an aligning unit for the sheets P, which is a characteristic part of the invention, will be explained.

Figure 9:
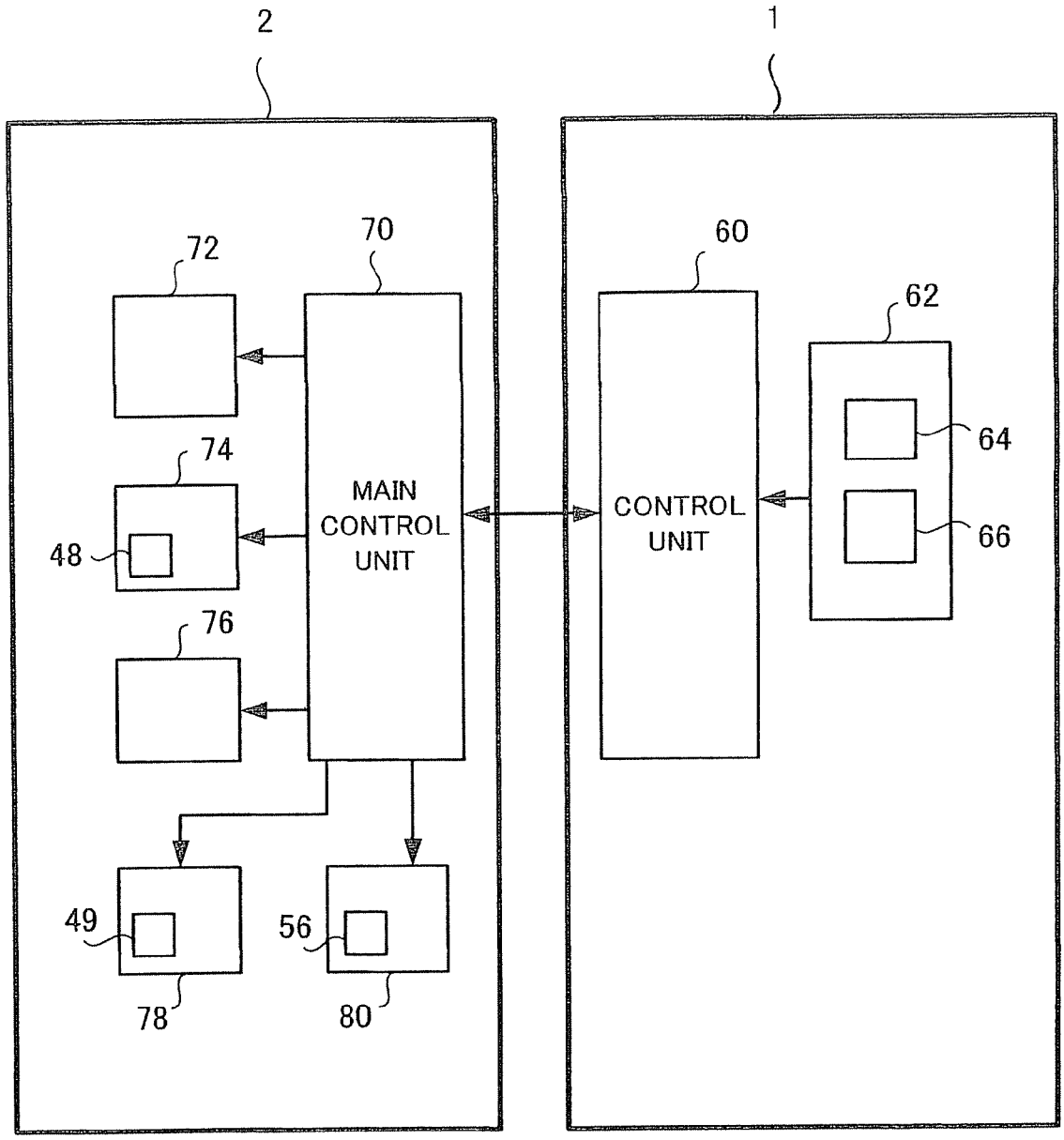
FIG. 9 is a block diagram showing a control system for the sheet processing apparatus of the invention.

FIG. 9 is a block diagram showing the control system that controls the post-processing apparatus 2. In FIG. 9, reference numeral 60 denotes a control unit that performs control of the image forming apparatus 1. For example, the control unit is constituted by a microprocessor including a CPU. The control unit performs, for image formation, control of the respective units in response to operation of an operation unit 62.

The operation unit 62 has various keys 64 and a display unit 66 of a touch panel type. For example, the user performs instructions for the number of copies and the like using the keys 64 and performs instructions for a sheet size, a sheet type, stapling, and the like by operating the touch panel of the display unit 66.

Reference numeral 70 denotes a main control unit that performs control of the sheet post-processing apparatus 2. For example, the main control unit 70 is constituted by a microprocessor including a CPU. The main control unit 70 performs transmission and reception of information to and from the control unit 60 of the image forming apparatus 1 and performs, for sheet post-processing, control of the respective units such that the operation of image formation and the operation of the sheet post-processing apparatus 2 cooperate with each other.

The main control unit 70 performs control of a stopper control unit 72, a horizontal-alignment control unit 74, a vertical-alignment control unit 76, a staple control unit 78, a discharge control unit 80, and the like.

The stopper control unit 72 controls a position of the stoppers 45. The horizontal-alignment control unit 74 drives the motor 48 to control positions of the horizontal aligning plates 47*a* and 47*b*. The vertical-alignment control unit 76 controls the rotation of the paddles 40 and the rotation of the rollers 28*a* and 28*b* to control a position in the vertical direction of the sheets P.

The staple control unit 76 derives the motor 49 to control a position of the stapler 14 and carry out stapling by the stapler 14. The discharge control unit 80 derives the motor 56 to control the movement of the conveyor belt 50 and control discharge of the sheets P.

Operations of the aligning processing and the staple processing for the sheets P will be explained with reference to FIGS. 10A and 10B. In an example described below, stapling is applied to two places at the trailing end of the sheets P.

Figure 10A:
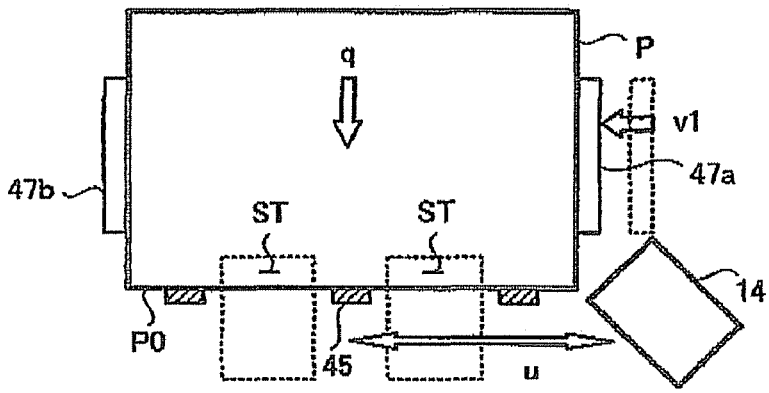
FIGS. 10A and 10B are explanatory diagrams for explaining operations of alignment and stapling of sheets in the sheet processing apparatus of the invention.

FIG. 10A shows a case in which sheets of a small size (e.g., the A4 size) are placed on the processing tray 12. At least one of the horizontal aligning plates 47*a* and 47*b* is slid in the direction of the sheets P and the sheets P are held between the horizontal aligning plates 47*a* and 47*b* to perform alignment in a direction (the horizontal direction) orthogonal to the conveying direction from both the sides of the sheets P. In FIG. 10A, a state in which the horizontal aligning plate 47*a* is slid in an arrow v1 direction from a position of a dotted line to a position of a solid line is shown.

When the sheets P are conveyed in the q direction, the stoppers 45 regulate a position of a trailing end P0 of the sheets P and aligns the sheets P in the conveying direction (the vertical direction). The stapler 14 applies stapling ST to the sheets P while moving in the arrow u direction from the position of the solid line. After the staple processing, the sheets P are discharged in a direction opposite to the q direction according to the rotation of the rollers 28*a* and 28*b* for vertical alignment and the movement of the conveyor belt 50.

Figure 10B:
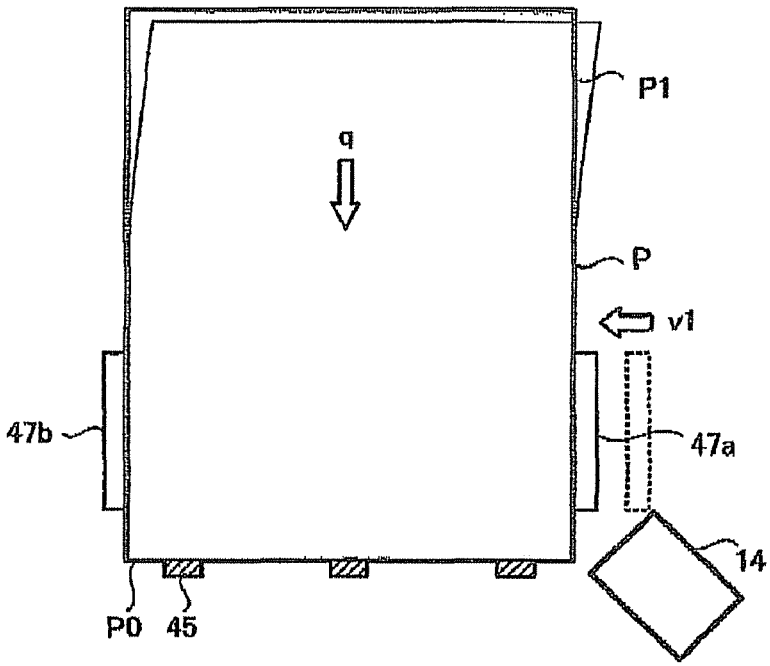

FIG. 10B shows a case in which the sheets P of a large size (e.g., the A3 size) are placed on the processing tray 12. In this case, the sheets P are held between the horizontal aligning plates 47*a* and 47*b* to perform alignment in the horizontal direction. However, when a regulating position of the sheets P by the stoppers 45 is the same as that in FIG. 10A, a leading end P1 of the sheets P is shaken and alignability is deteriorated. This is because an alignment position in the horizontal direction with respect to the sheets P of the large size is close to the trailing end P0 of the sheets P.

Figure 11A:
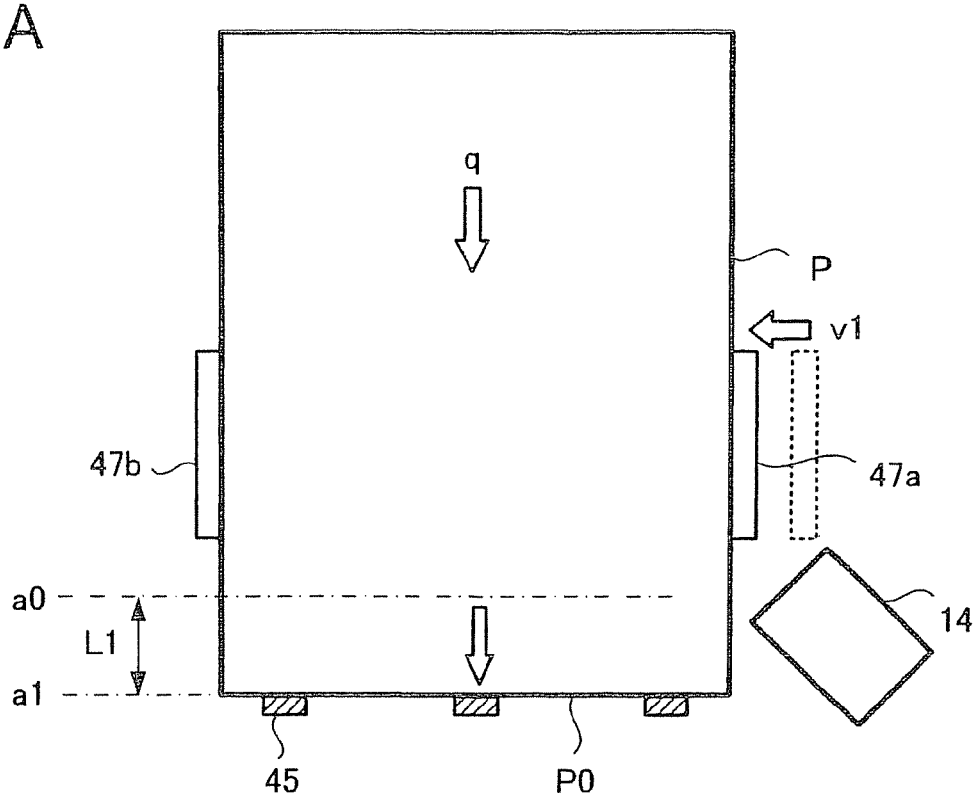
FIGS. 11A and 11B are explanatory diagrams for explaining operations of alignment and stapling of sheets of a large size in the sheet processing apparatus of the invention.
Figure 11B:
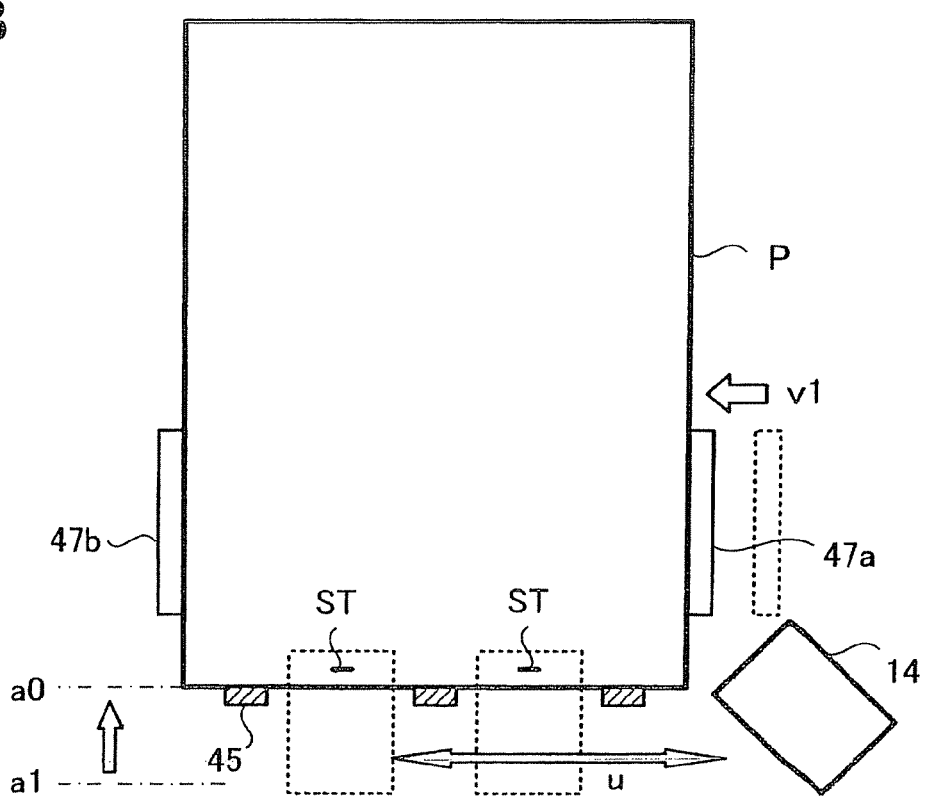

Thus, as shown in FIG. 11A, in the invention, when the sheets P of the large size is subjected to the staple processing, the position of the stoppers 45 is slid by a distance L1 to the second position a1 further in a depth direction than the first position a0. The sheets P are conveyed to the second position a1 by the vertical-alignment control unit 74. Consequently, since the vertical aligning plates 47*a* and 47*b* align a portion close to the center of the sheets P from both the sides thereof, it is possible to control disarrangement of the leading end P1 of the sheets P.

When the horizontal alignment is performed, the stoppers 45 return to the first position a0 by the stopper control unit 72. In that position, the stapler 14 applies the stapling ST to the sheets P while moving in the arrow u direction. After the staple processing, the sheets P are discharged in a direction opposite to the q direction by the discharge control unit 80.

The position of the stoppers 45 is controlled by the stopper control unit 72 when the user operates the operation unit 62 to select sheets of the large size and is slid to the second position a1. After the horizontal alignment, the position of the stoppers 45 returns to the first position a0.

In this way, in the invention, it is possible to reduce disarrangement of the sheets of the large size when the sheets are horizontally aligned. The same effect is obtained if the position of the stapler 14 is shifted to the second position a1 in advance. However, since the stapler 14 has a large shape, if the position of the stapler 14 is shifted to the second position a1, the size of the entire post-processing apparatus 2 is undesirably increased.

Figure 12A:
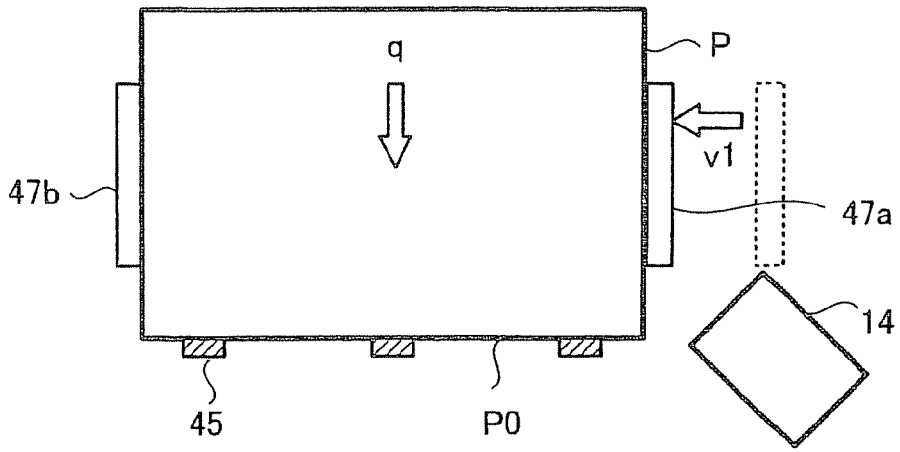
FIGS. 12A and 12B are explanatory diagrams for explaining a stapling operation in another embodiment of the sheet processing apparatus of the invention.
Figure 12B:
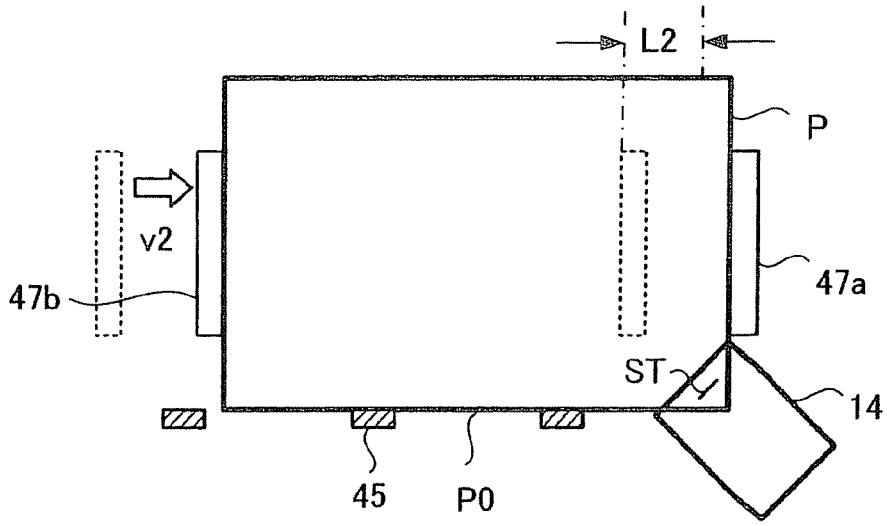

FIGS. 12A and 12B are diagrams for explaining another embodiment of the invention. In FIGS. 12A and 12B, the stapler 14 is a stapler of a fixed type and the stapling ST is applied to only one place at a corner of the sheets P.

FIG. 12A shows a state in which the sheets P of a small size (e.g., the A4 size) are placed on the processing tray 12, the horizontal aligning plate 47*a* is slid in the arrow v1 direction from a position of a dotted line to a position of a solid line, and alignment of the sheets P in the horizontal direction is performed. When the sheets P are conveyed in the q direction in this state, the stoppers 45 regulate a position of the trailing end P0 of the sheets P.

When the stapling ST is applied to the sheets P, as shown in FIG. 12B, the horizontal aligning plates 47*a* and 47*b* are moved in an arrow v2 direction, the sheets P subjected to the horizontal alignment are moved by a distance L2 in the direction of the stapler 14, and the stapling ST is applied to the sheets P. After the staple processing, the sheets P are discharged in a direction opposite to the q direction according to the rotation of the rollers 28*a* and 28*b* for vertical alignment and the movement of the conveyor belt 50.

Figure 13A:
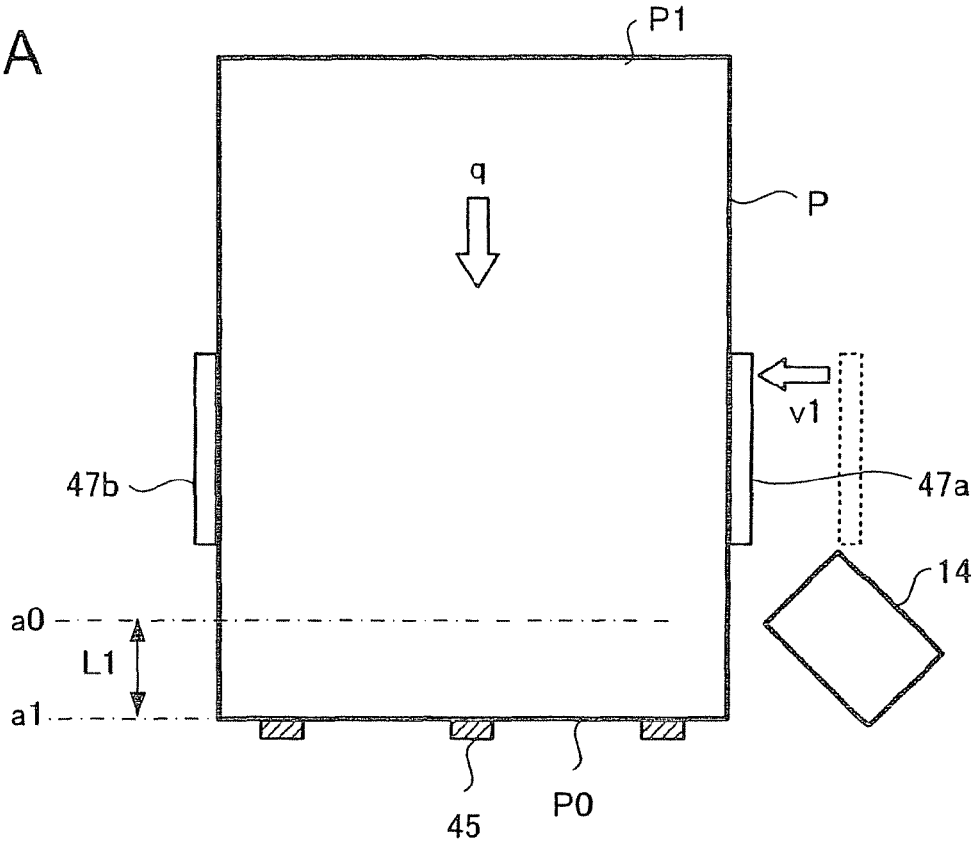
FIGS. 13A and 13B are explanatory diagrams for explaining a stapling operation for large-size sheets in still another embodiment of the sheet processing apparatus of the invention.

FIG. 13A shows a case in which the sheets P of a large size (e.g., the A3 size) are stapled by the stapler 14 of the fixed type. When the sheets P of the large size are subjected to the staple processing, a position of the stoppers 45 is slid to the second position a1 in a depth direction from the first position a0. Consequently, since the horizontal aligning plates 47*a* and 47*b* align a portion close to the center of the sheets P, it is possible to control disarrangement of the leading end P1 of the sheets P.

Figure 13B:
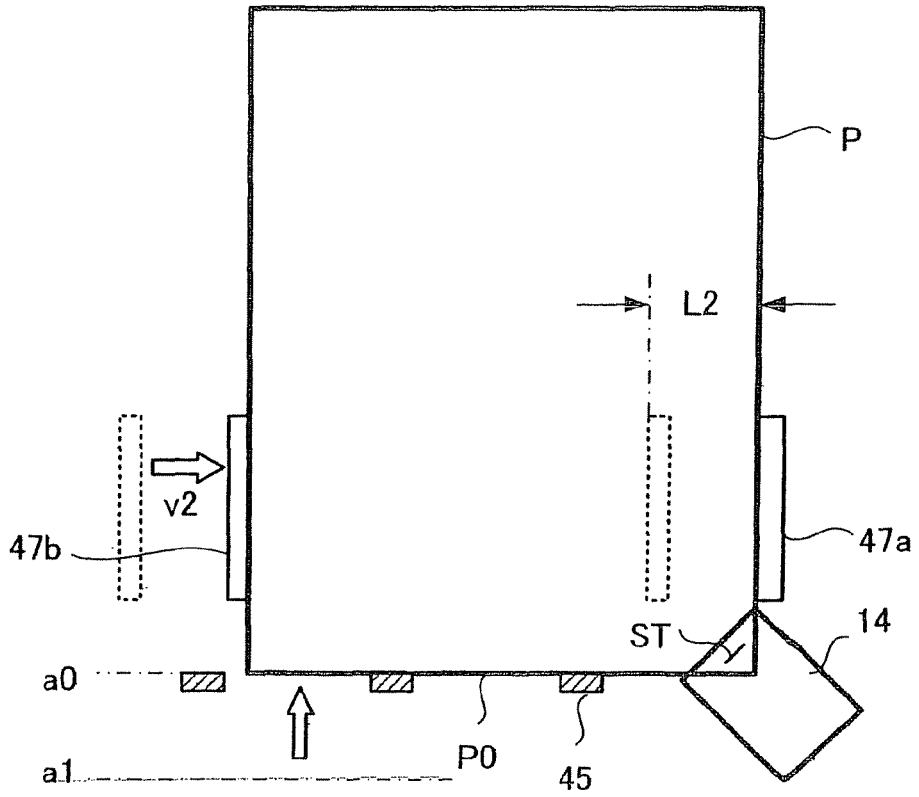

As shown in FIG. 13B, the stoppers 45 return to the first position a0 from the second position a1. After that, the horizontal aligning plates 47*a* and 47*b* are moved in the arrow v2 direction. Consequently, the sheets P horizontally aligned move in the direction of the stapler 14 and the stapling ST is applied to the sheet P. After the staple processing, the sheets P are discharged in a direction opposite to the q direction.

Therefore, even if the stapler 14 is the fixed type, it is possible to surely perform the horizontal alignment and applies the staple processing to the sheets P.

When sort processing is performed, in the same manner, after a position of the stoppers 45 is controlled to perform accurate horizontal alignment processing according to a sheet size, the sort processing is performed using the horizontal aligning plates 47*a* and 47*b* and the sheets P are discharged.

In this way, in the invention, it is possible to carry out accurate alignment, stapling, and sort without causing disorder of alignment regardless of whether sheets are sheets of a small size or sheets of a large size.

The invention is not limited to the above explanation. Various modifications are possible in a range not departing from the scope of the claims. For example, in the above explanations, as sheet sizes, the sheets of the A4 and A3 sizes are processed. However, the invention is also applicable to a case in which sheets of other sizes are processed.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet processing apparatus that applies post-processing to sheets conveyed from an image forming apparatus, comprising:

a post-processing unit for applying the post-processing to the sheets conveyed from the image forming apparatus;

a first aligning unit configured to convey the sheets in a first direction toward the post-processing unit and bring an edge of the sheets into contact with a movable stopper, which is arranged in a conveying path for the sheets, to align the sheets in a conveying direction;

a second aligning unit configured to hold the sheets with a pair of movable aligning plates from both sides along the first direction to align the sheets in a direction orthogonal to the conveying direction; and a control unit configured to discriminate a size of the sheets on the basis of input information from an operation unit provided in the image forming apparatus and switch a position of the stopper according to the size of the sheets discriminated, and control the pair of aligning plates to be located on both sides close to a center of the sheets when the sheets are brought into contact with the stopper, wherein the post-processing unit applies the post-processing to the sheets aligned.

2. A sheet processing apparatus according to claim 1, wherein the post-processing unit is a stapler and applies stapling to the sheets aligned.

3. A sheet processing apparatus according to claim 1, wherein the post-processing unit is a sorter that sorts the sheets aligned by shifting the pair of aligning plates in a direction orthogonal to the conveying direction of the sheets.

4. A sheet processing apparatus that applies post-processing to sheets conveyed from an image forming apparatus, comprising:

a processing tray on which it is possible to place the sheets conveyed from the image forming apparatus;

a post-processing unit for applying the post-processing to the sheets placed on the processing tray;

a first aligning unit configured to convey the sheets on the processing tray in a first direction toward the post-processing unit and bring an edge of the sheets into contact with a movable stopper, which is arranged to be orthogonal to the first direction, to align the sheets in a vertical direction;

a second aligning unit configured to include a pair of movable aligning plates, which hold the sheets from both sides along the first direction, to align the sheets in a horizontal direction;

a control unit configured to discriminate a size of sheets to be processed by the post-processing unit on the basis of input information from an operation unit provided in the image forming apparatus and to switch a position of the stopper according to the size of the sheets to be discriminated, control the pair of aligning plates to be located on both sides close to a center of the sheets when the sheets are brought into contact with the stopper, and control the post-processing apparatus to apply the post-processing to the sheets aligned; and a sheet discharging unit configured to discharge the sheets subjected to the post-processing by the post-processing unit.

5. A sheet processing apparatus according to claim 4, wherein the post-processing unit is a stapler movable along an edge of the sheets, and the control unit switches, when a position of the edge of the sheets aligned in the vertical direction and a position of the stapler deviate from each other, the position of the stopper and controls the position of the end of the sheets to coincide with the position of the stapler.

6. A sheet processing apparatus according to claim 4, wherein the post-processing unit is a stapler of a fixed type that applies stapling to a corner of the sheets, the control unit switches, when the corner of the sheets aligned in the vertical direction and the position of the stapler deviate from each other, the position of the stopper and control a position of the end of the sheets to coincide with the position of the stapler, and the second aligning unit moves the pair of aligning plates and guides the sheets to the stapler.

7. A sheet processing method of applying post-processing to sheets conveyed from an image forming apparatus, comprising:

placing sheets conveyed from the image forming apparatus on a processing tray;

conveying the sheets on the processing tray in a first direction toward a post-processing unit and brings an edge of the sheets into contact with a movable stopper, which is arranged to be orthogonal to the first direction, to align the sheets in a vertical direction;

holding the sheets from both sides along the first direction with a pair of movable aligning plates to align the sheets in a horizontal direction;

discriminating a size of sheets to be processed by the post-processing unit on the basis of input information from an operation unit provided in the image forming apparatus;

switching a position of the stopper according to the size of the sheets discriminated and controlling the pair of aligning plates to be located on both sides near a center of the sheets when the sheets are brought into contact with the stopper; and applying the post-processing to the sheets aligned with the post-processing unit and discharging the sheets.

8. A sheet processing method according to claim 7, wherein the post-processing unit is a stapler movable along the edge of the sheet and, when a position of the edge of the sheets aligned in the vertical direction and a position of the stapler deviate from each other, the position of the stopper is switched, the position of the edge of the sheets is controlled to coincide with the position of the stapler.

9. A sheet processing apparatus according to claim 7, wherein the post-processing unit is a stapler of a fixed type that applies stapling to a corner of the sheets and, when the corner of the sheets aligned in the vertical direction and a position of the stapler deviate from each other, the position of the stopper is switched, the position of the edge of the sheets is controlled to coincide with the position of the stapler, and the pair of aligning plates are moved to guide the sheets to the stapler.

* * * * *